US007196323B2

(12) United States Patent
Walk et al.

(10) Patent No.: US 7,196,323 B2
(45) Date of Patent: Mar. 27, 2007

(54) MASS SPECTROMETRY METHOD FOR ANALYZING MIXTURES OF SUBSTANCES

(75) Inventors: Tilmann B. Walk, Berlin (DE); Martin Dostler, Henningsdorf (DE)

(73) Assignee: Metanomics GmbH & Co. KGaA (DE)

( * ) Notice: Subject to any disclaimer, the term of this patent is extended or adjusted under 35 U.S.C. 154(b) by 192 days.

(21) Appl. No.: 10/505,154
(22) PCT Filed: Feb. 10, 2003

(86) PCT No.: PCT/EP03/01274

§ 371 (c)(1),
(2), (4) Date: Aug. 20, 2004

(87) PCT Pub. No.: WO03/073464

PCT Pub. Date: Sep. 4, 2003

(65) Prior Publication Data

US 2005/0103991 A1 May 19, 2005

(30) Foreign Application Priority Data

Feb. 28, 2002 (DE) ..... 102 08 625
Feb. 28, 2002 (DE) ..... 102 08 626

(51) Int. Cl.
*H01J 49/42* (2006.01)

(52) U.S. Cl. ..... 250/282; 250/292

(58) Field of Classification Search ..... 250/282, 250/288, 292, 290

See application file for complete search history.

(56) References Cited

U.S. PATENT DOCUMENTS 4,540,884 A 9/1985 Stafford et al.
5,397,894 A 3/1995 Wells et al.
6,093,929 A * 7/2000 Javahery et al. ..... 250/282
6,140,638 A 10/2000 Tanner et al.
6,428,956 B1 * 8/2002 Crooke et al. ..... 435/6
7,034,292 B1 * 4/2006 Whitehouse et al. ..... 250/289

OTHER PUBLICATIONS

Esmans, E.L., et al., "Liquid Chromatography-Mass Spectrometry in Nucleoside, Nucleotide and Modified Nucleotide Characterization," *Journal of Chromatography A.,* 794:109-127 (1998).
Niessen, W.M.A., et al., "Liquid Chromatography-Mass Spectrometry General Principles and Instrumentation," *Journal of Chromatography A.,* 703:37-57 (1995).
Zenobi, Renato, et al., "Ion Formation in Maldi Mass Spectrometry," *Mass Spectrometry Reviews,* 17:337-366 (1988).
Hopfgartner, G., et al., "The Impact of Accurate Mass Measurements Using Quadrupole/Time-of-Flight Mass Spectrometry on the Characterisation and Screening of Drug Metabolites," *Analusis,* 28(10):906-914 (2001).

* cited by examiner

*Primary Examiner*—Kiet T. Nguyen
(74) *Attorney, Agent, or Firm*—Connolly Bove Lodge & Hutz LLP

(57) ABSTRACT

The invention relates to a mass spectrometry method for analysing mixtures of substances using a triple quadrupole mass spectrometer, whereby said mixtures of substances are ionised prior to analysis. The invention is characterised in that the method comprises the following steps: a) selection of a mass/charge quotient (m/z) of an ion created by ionisation in a first analytical quadrupole (I) of the mass spectrometer; b) fragmentation of the ion selected in step (a) by applying an acceleration voltage in an additional subsequent quadrupole (II), which is filled with a collision gas and acts as a collision chamber; c) selection of a mass/charge quotient of an ion created by the fragmentation process in step (b) in an additional subsequent quadrupole (III), whereby steps (a) to (c) of the method are carried out at least once; and d) analysis of the mass/charge quotients of all the ions present in the mixture of substances as a result of the ionisation process, whereby the quadrupole (II) is filled with collision gas, but no acceleration voltage is applied during the analysis. Steps (a) to (c) and step (d) can also be carried out in reverse order.

20 Claims, 15 Drawing Sheets

Schematic diagram of the analytical process

Figure 1: Schematic diagram of the analytical process

Figure 2: Total ion chromatogram (TIC) of an MRM + full scan analysis
TIC: from Sample 2 (QC 1) of LCMS04_020207_OF1.wiff Figure 3: Total ion chromatogram (TIC) of the MRM experiment from an MRM + FS analysis
TIC of +MRM (30 pairs): Experiment 1, from Sample 2 (QC1) of LCMS04_020207_0F1.wiff Figure 4: Total ion chromatogram (TIC) of the MRM experiment from an MRM + FS analysis
XIC of +MRM (30 pairs): Experiment 1,536,4/69,0 amu from Sample 2 (QC1) of LCMS04_020207_0F1.wiff Figure 7: TIC of the FS experiment (+Q3: Experiment 2; 1.491 to 2.004 min from Sample 2 (QC1) of LCMS04_020207_0F1.wiff)
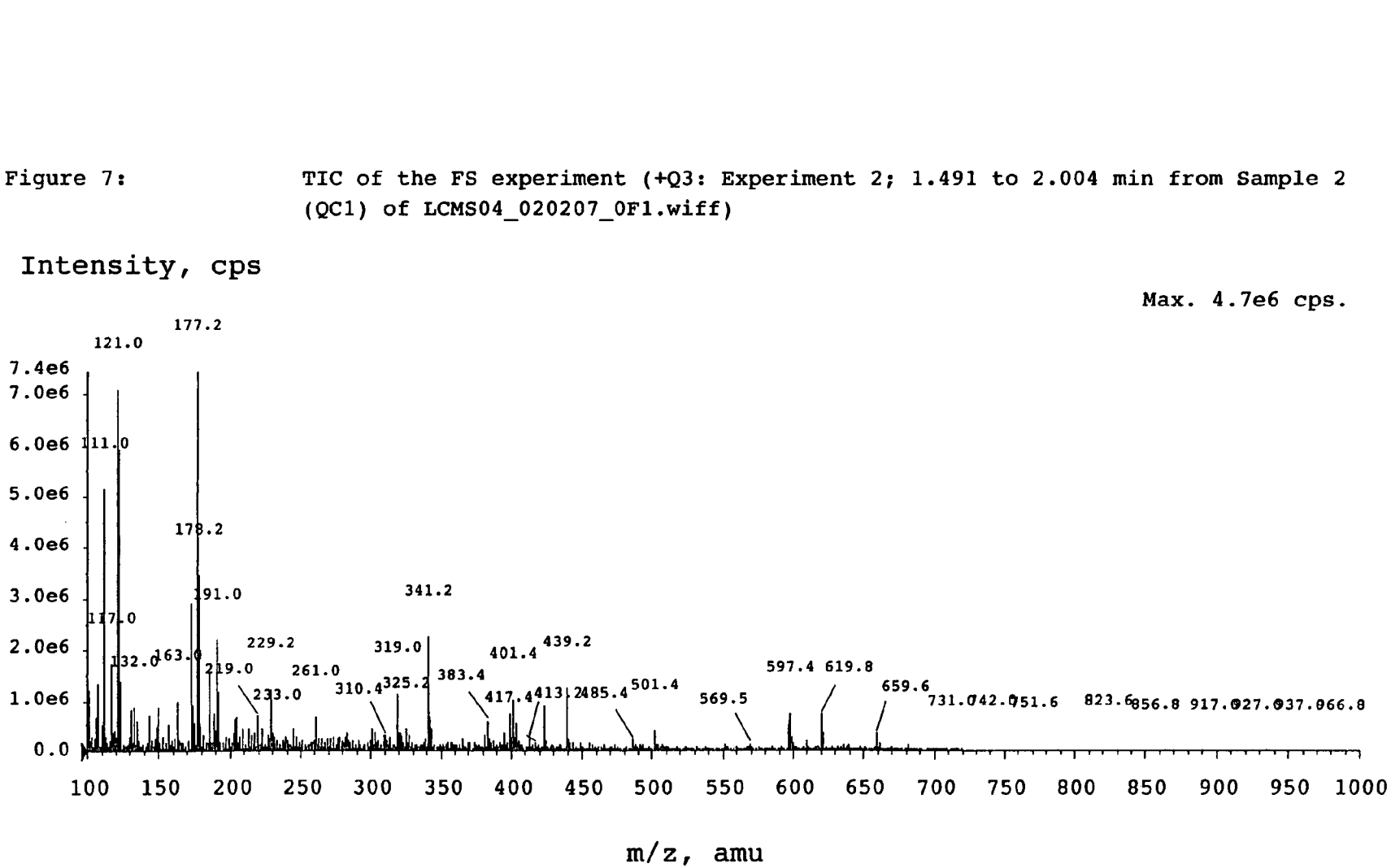

Figure 8: Total ion chromatogram (TIC) of MRM experiment
TIC of MRM (36 pairs): Experiment 1 from Sample 2 (Kalibmix-lip-14.08.2002-14)
of LCMS02_020814_OF3.wiff)
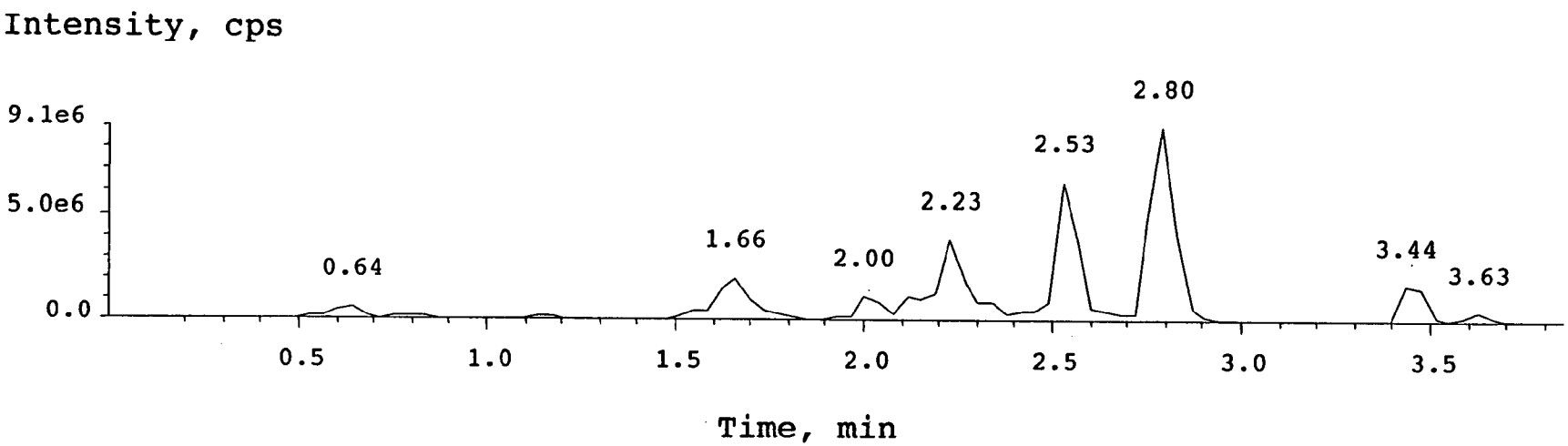

Figure 9: Extracted chromatogram from m/z transition 863.7 to 197 (coenzyme Q10) TIC of MRM (36 pairs): Experiment 1; 863.7/197,0 amu from Sample 2 (Kalibmix-lip-14.08.2002-14) of LCMS02_020814_OF3.wiff)
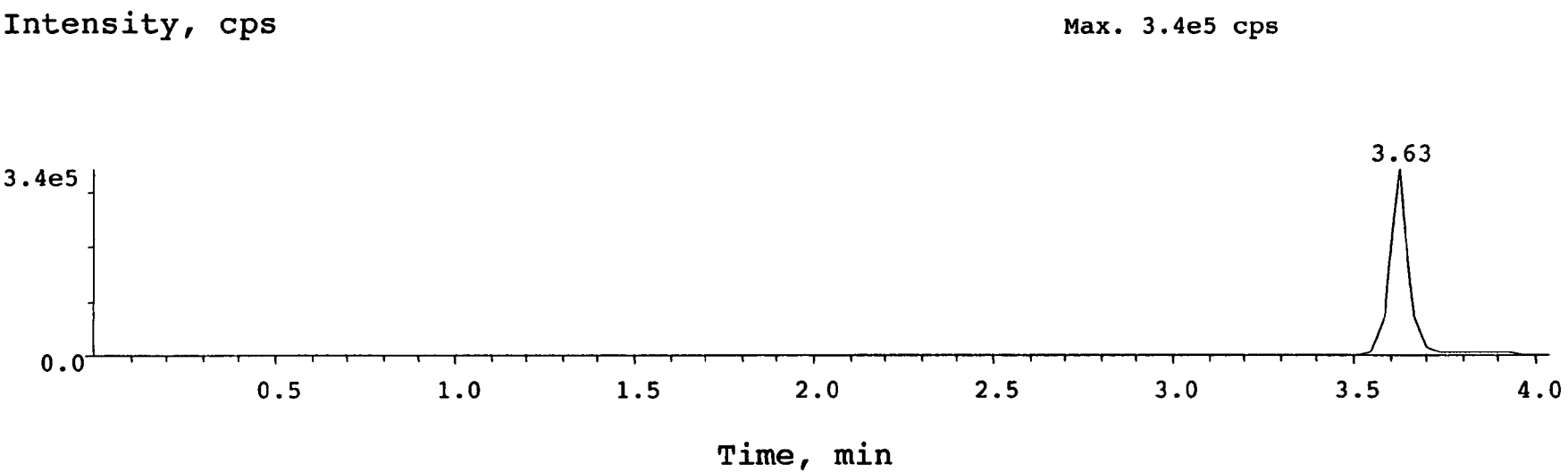

Figure 10: Extracted chromatogram from m/z transition 585.4 to 109.1 (capsanthin) TIC of MRM (36 pairs): Experiment 1; 585.4/109.1 amu from Sample 2 (Kalibmix-lip-14.08.2002-14) of LCMS02_020814_0F3.wiff)
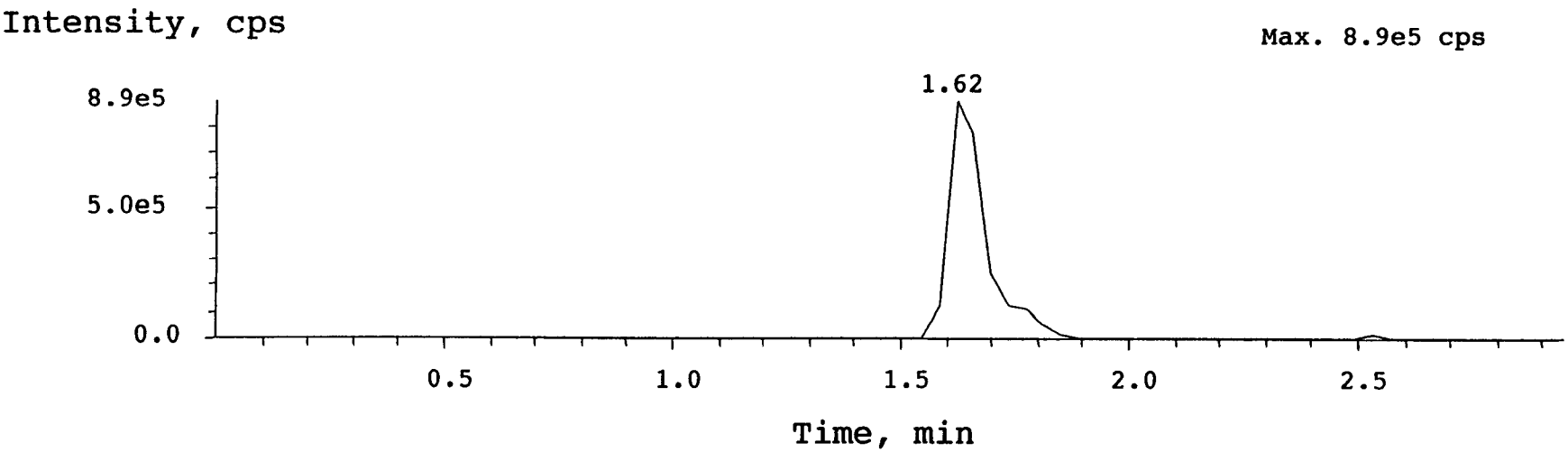

Figure 11: Extracted chromatogram from m/z transition 395.1 to 91.1 (bixin)
TIC of MRM (36 pairs): Experiment 1; 395.1/91.1 amu from Sample 2
(Kalibmix-lip-14.08.2002-14) of LCMS02_020814_0F3.wiff)
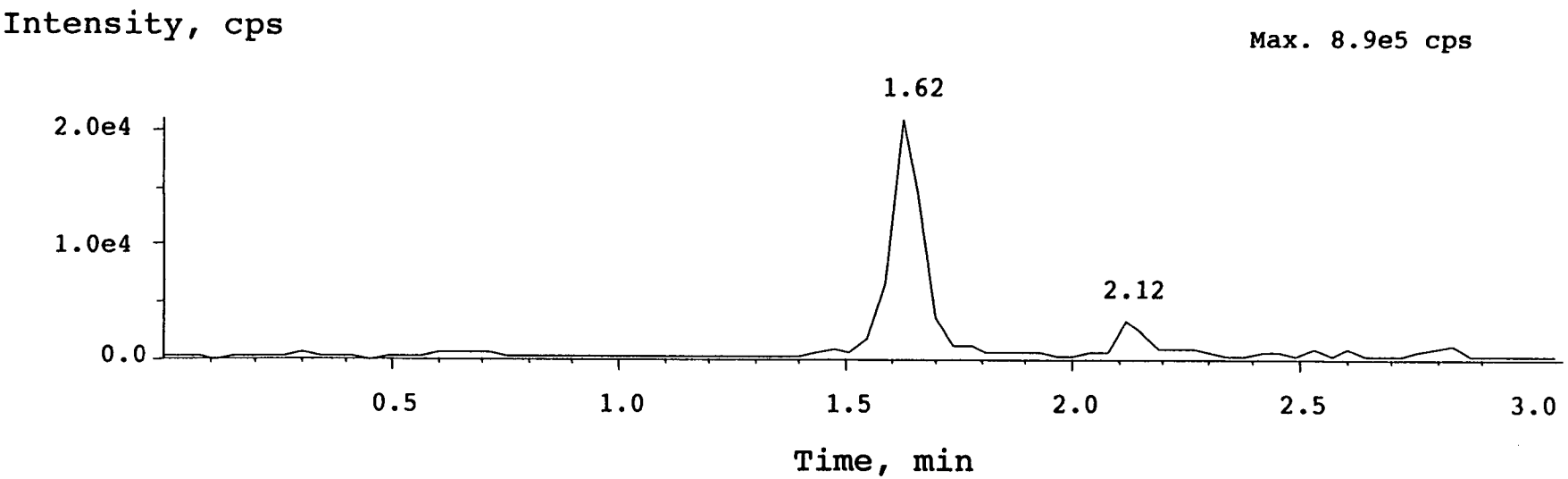

Figure 12: Total ion chromatogram (TIC) of FS experiment
TIC of +Q3: Experiment 2 from Sample 4
[LC-L1HA-lip-12.08.2002-(84)-676735 of LCMS02_020814_OF3.wiff]
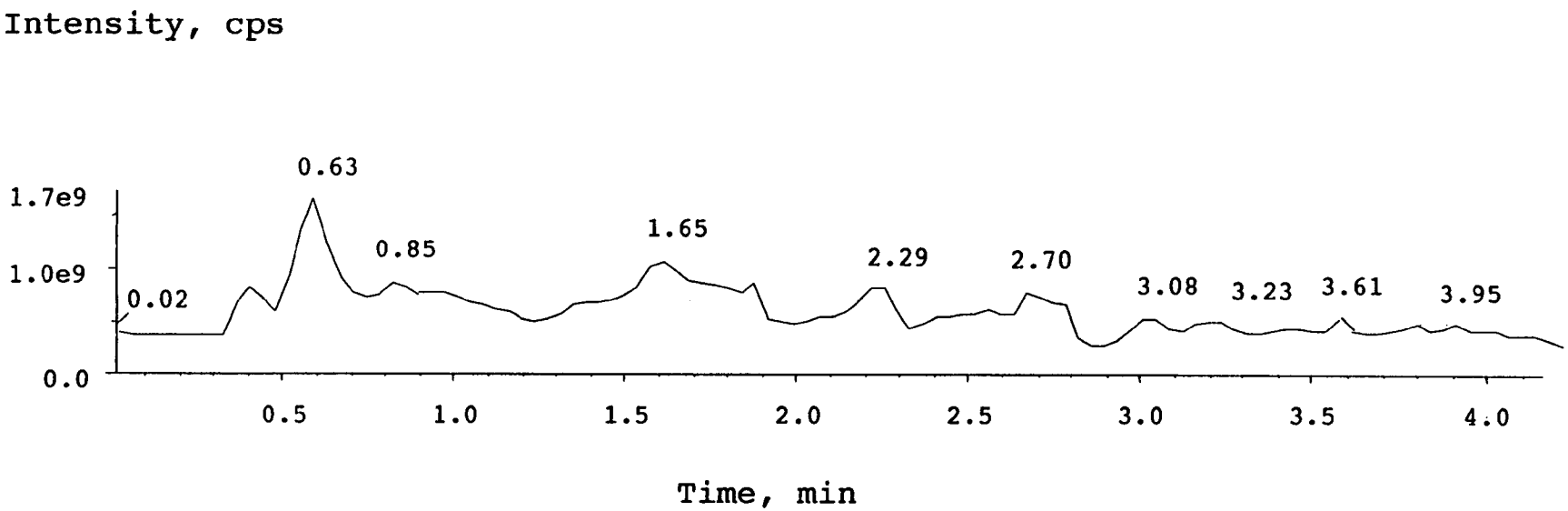

Figure 13: Extracted chromatogram from signal m/z 518.4 (metanomics analyte 600000038)
XIC of +Q3: Experiment 2; 518.4 amu from Sample 4
[LC-L1HA-lip-12.08.2002-(84)-676735 of LCMS02_020814_OF3.wiff]
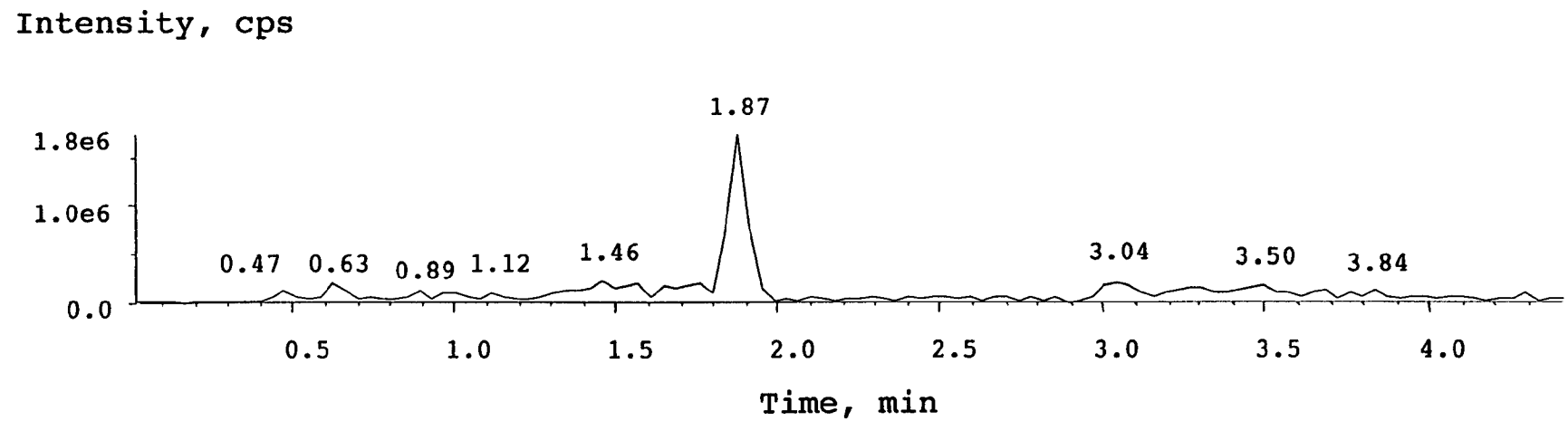

Figure 14: Extracted chromatogram from signal m/z 609.2 (metanomics analyte 600000049)
XIC of +Q3: Experiment 2; 609.2 amu from Sample 4
[LC-L1HA-lip-12.08.2002-(84)-676735 of LCMS02_020814_OF3.wiff]
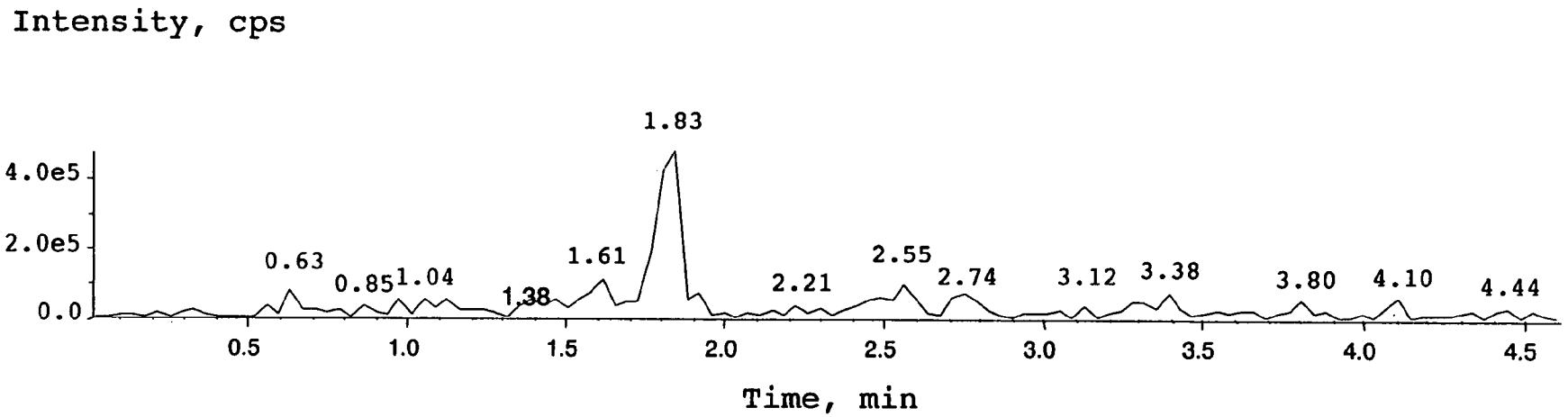

Figure 15: Extracted chromatogram from signal m/z 210.0 (metanomics analyte 600000007)
XIC of +Q3: Experiment 2; 210.0 amu from Sample 4
[LC-L1HA-lip-12.08.2002-(84)-676735 of LCMS02_020814_OF3.wiff]
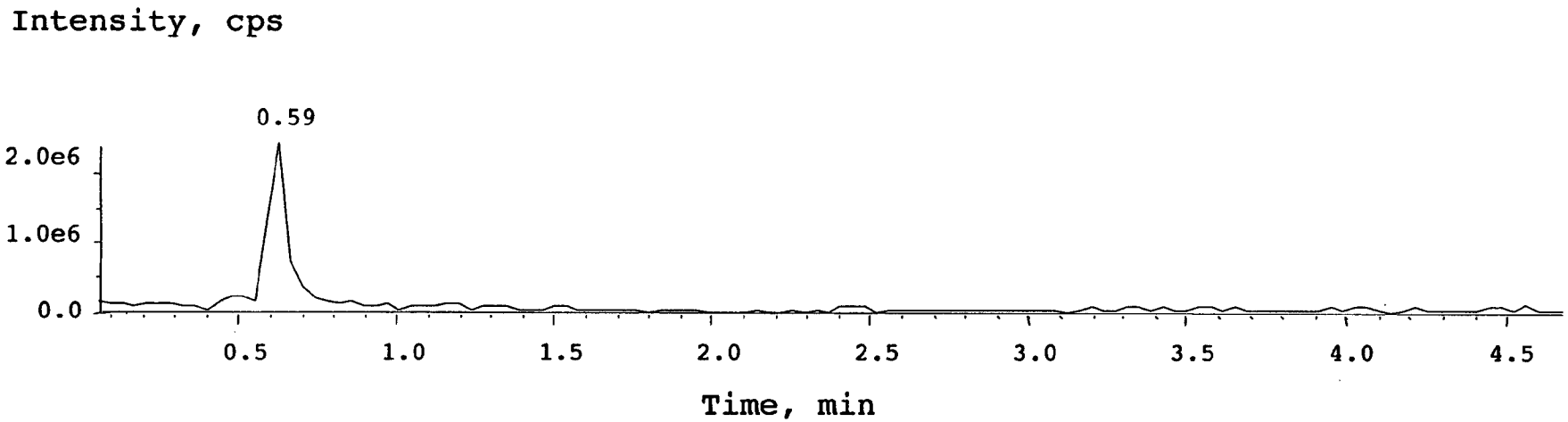

MASS SPECTROMETRY METHOD FOR ANALYZING MIXTURES OF SUBSTANCES

RELATED APPLICATIONS

This application is a national stage application (under 35 U.S.C. 371) of PCT/EP03/01274 filed Feb. 10, 2003, which claims benefit of German application 102 08 626.5 filed Feb. 28, 2002, and German application 102 08 625.7 filed Feb. 28, 2002.

FIELD OF THE INVENTION

The present invention relates to a mass spectrometry process for analyzing substance mixtures using a triple quadrupole mass spectrometer.

DESCRIPTION OF THE BACKGROUND

In the analysis of complex substance mixtures of biological and/or chemical origin, the analyst not only has the task of identifying the structure of individual substances present in the mixture, but also has the problem every time of capturing all substances present in the mixture and quantifying them if at all possible. This should proceed very rapidly and with high precision, i.e. with a small error deviation. This becomes all the more important when information is to be obtained on a biological system, for example on a microorganism grown under certain fermentation conditions or on a plant grown under different environmental conditions or on a wild type organism such as a microorganism or a plant in comparison to its genetically modified mutant. Such comparisons are necessary in order to enable assignment of mutations of unknown genes in the genome of these organisms to a certain metabolic phenotype.

The success in the analysis of these substance mixtures, for example chemical synthesis mixtures, from combinatorial chemistry or from extracts from microorganisms, plants or plant parts depends to a great extent upon the rapidity and reproducibility of the analysis used. In such a screening, a multitude of samples have to be scanned through; rapid, simple, highly sensitive and highly specific analytical processes are therefore required.

A main problem of this analysis is the rapid, simple, reproducible and quantifiable identification of the substances present in the mixtures. In general, the products are analyzed using separation processes such as thin-layer chromatography (=TLC), high-pressure liquid chromatography (=HPLC) or gas chromatography (=GC). However, it is not possible with the aid of these chromatographic processes to rapidly and simply identify and quantify a wide range of substances. Processes such as NMR or mass spectrometry have also been described for this task. However, a certain degree of preparation of the samples is generally required for these analytical processes, such as workup via, for example, salt precipitation and/or subsequent chromatography, concentration, desalting of the samples, buffer exchange or removal of any detergents present in the sample.

After this pretreatment, the samples can be used for the aforementioned analyses and it is possible to identify and quantify individual substances in selected samples. However, these processes are time-consuming and only permit a limited sample throughput, so that such analytical processes do not find use in high-throughput screening (=HTS) or the broad screening of substance mixtures in biological or chemical samples. An advantage in very precise methods such as NMR or IR spectroscopy is that they provide information both on the structure and, in some cases, on the quantity of a substance.

In order to enable higher sample throughput in HTS, indirect, readily measurable processes such as color reactions in the visible region, cloudiness measurements, fluorescence, conductivity measurements, etc. are used in many cases. Although they are in principle very sensitive, they are also prone to faults. Disadvantages in this case are in particular that many falsely positive samples are analyzed in this procedure, and that, since they are indirect detection processes, there is no information about the structure and/or the quantity of a compound. In order to be able to exclude these false positives in the further procedure, further analytical processes, for example NMR, IR, HPLC-MS or GC-MS, are generally used after a first rapid analysis. This is again very time-consuming.

Generally, it can be stated that the improvement in the sensitivity and the conclusiveness of the detection processes leads to a decrease in the speed of an analysis.

When working with complex biological mixtures, for example extracts from microorganisms, plants and/or animals, it also has to be taken into account that individual compounds are present in the mixtures only in very small amounts or only small amounts of the individual sample itself are available for the analysis, so that the method used has to have a high sensitivity. Moreover, the involatile buffers and/or salts frequently present in biological samples constitute a problem for some analysis methods, since they adversely affect the sensitivity of the methods or indeed their use. The same applies to the presence of detergents in these samples.

For the analysis of complex sample mixtures, the prior art discloses mass spectrometry processes which range, for example, from the analysis of samples from synthetic chemistry, petrochemistry, environmental samples and biological material. However, these methods are used only for the analysis of individual known compounds in these samples. Wide measurement ranges, for example in the context of an HTS or in the identification and quantification of a multitude of compounds in these samples, are not described.

One method that finds use for substances which are extractable from the substance mixtures and are volatile is the coupling of gas chromatography and mass spectrometry (=GC-MS). For the analysis of substances or analytes which cannot easily be transferred to the gas phase or only with difficulty and for which a large excess of solvent present has to be removed, liquid chromatography- or high-pressure liquid chromatography-mass spectrometry (=HPLC-MS) is used. A review of the different LC-MS methods and their equipment can be taken from the publication of Niessen et al. (Journal of Chromatography A, 703, 1995: 37–57). The US documents U.S. Pat. No. 4,540,884 and U.S. Pat. No. 5,397,894 describe and claim mass spectrometers and their construction.

With the aid of the aforementioned methods, it is possible to determine substances in a molecular weight range of up to 100 kD (=kilodaltons), i.e. it is possible to determine a wide range of substances, for example in a lower mass range of up to about 5000 D (=daltons) such as fatty acids, amino acids, carboxylic acids, oligo- or polysaccharides, steroids, etc., and/or in a higher mass range above 5000 D such as peptides, proteins, oligonucleotides and oligosaccharides or other polymers. It is also possible to analyze high molecular weight materials such as coal tar, humic acid, fulvic acid or kerogens (Zenobie and Kno-chenmuss, Mass Spec. Rev., 1998, 17, 337–366). It is possible to determine both the identity and the structure of substances, although the structural analysis is not always unambiguous, so that it has to be confirmed using other methods, for example NMR.

G. Hopfgartner and F. Vilbois (Analysis, 2001, 28, No. 10, 906–914) describe a process for screening with the aid of LC-MS of metabolites, formed in vitro or in vivo, of compounds of known structure which are as active ingredients in different phases of the active ingredient development. This process proceeds in two steps. In the first search step, ions of interest are captured in a rapid"full scan mode", said ions being possible candidates for the further investigations. They may be ions which correspond to ions of particularly high intensity or be candidates of possible decomposition products or metabolites of the active ingredients. These ions are used in a second scan for identifying the chemical structure of these ions or compounds after a fragmentation in a collision chamber of the mass spectrometer. In order to enable rapid elucidation of the ion or metabolite structure, the collision chamber always contains collision gas. A disadvantage in the structural determination is that a known mass of a precursor ion, of a fragment or of an ion adduct is required. Advantageously, the starting structure of the substance to be investigated should be known for the HPLC-MS in these experiments. Since HPLC-MS alone is unsuitable for absolute structural determination, but the structure of the starting compound is known, it is possible to make statements about the structure of any metabolites. Since the structure of the substance which is to be developed as an active ingredient is known, statements can be made about the structure of the unknown metabolites of the active ingredient with some certainty. However, the statement is complicated or prevented by possible overlappings of other compounds of the same mass which are present as impurities. It is not possible to quantify the compounds by this method.

Identification and quantification of a multitude of or all individual components in a substance mixture without pure substances being available even today still constitutes an unsolved problem in mass spectrometry.

SUMMARY OF THE INVENTION

It is therefore an object of the present invention to develop a process for analyzing a multitude of compounds and preferably for their quantification.

This object is achieved by a mass spectrometry process for analyzing substance mixtures using a triple quadrupole mass spectrometer, said substance mixtures being ionized before the analysis, which comprises the following steps a) selecting a mass/charge quotient (m/z) of an ion formed by ionization in a first analytical quadrupole (I) of the mass spectrometer,
b) fragmenting the ion selected under (a) by applying an acceleration voltage in a further following quadrupole (II) which is filled with a collision gas and functions as a collision chamber,
c) selecting a mass/charge quotient of an ion formed by the fragmentation (b) in a further downstream quadrupole (III), the process steps (a) to (c) being run through at least once, and
d) analyzing the mass/charge quotients of all ions present in the substance mixture as a result of the ionization, the quadrupole (II) being filled with collision gas but no acceleration voltage being applied during the analysis;

and the steps (a) to (c) and step (d) may also be carried out in reverse sequence.

Other embodiments and advantages of the invention are set forth in part in the description, which follows, and in part, may be obvious from this description, or may be learned from the practice of the invention.

DESCRIPTION OF THE FIGURES

FIG. 7. TIC of the FS experiment (+Q3: Experiment 2 from Sample 2; 1.491 to 2.004 mm from Sample 2 (QC 1) of LCMS04_020207_0F1.wiff).

FIG. 8. Total ion chromatography (TIC) of MRM experiment; TIC of MRM (36 pairs): Experiment 1 from Sample 2 (Kalibmix-lip-14.08.2002-14) of LCMS02_020814_0F3.wiff).

FIG. 9. Extracted chromatograph from m/z transition 863.7 to 197 (coenzyme Q10) TIC of MRM (36 pairs): Experiment 1; 863;7/197.0 amu from Sample 2 (Kalibmix-lip-14.08.2002-14) of LCMS02_020814_0F3.wiff).

FIG. 10. Extracted chromatograph from m/z transition 585.4 to 109.1 (capsanthin) TIC of MRM (36 pairs): Experiment 1; 585.4/109.1 amu from Sample 2 (Kalibmix-lip-14.08.2002-14) of LCMS02_020814_0F3.wiff).

FIG. 11. Extracted chromatograph from m/z transition 395.1 to 91.1 (bixin) TIC of MRM (36 pairs): Experiment 1; 395.1/91.1 amu from Sample 2 (Kalibmix-lip-14.08.2002-14) of LCMS02_020814_0F3.wiff).

FIG. 12. Total ion chromatograph (TIC) of FS experiment TIC of +Q3: Experiment 2 from Sample 4 [LC-L1HA-lip-12.08.2002-(84)-676735 of LCMS02_020814_0F3.wiff].

FIG. 13. Extracted chromatograph from signal m/z transition 518.4 (metanomics analyte 600000038) XIC of +Q3: Experiment 2; 518.4 amu from Sample 4 [LC-L1HA-lip-12.08.2002-(84)-676735 of LCMS02_020814_0F3.wiff].

FIG. 14. Extracted chromatograph from signal m/z transition 609.2 (metanomics analyte 600000049) XIC of +Q3: Experiment 2; 609.2 amu from Sample 4 [LC-L1HA-lip-12.08.2002-(84)-676735 of LCMS02_020814_0F3.wiff].

FIG. 15. Extracted chromatograph from signal m/z 210.0 (metanomics analyte 600000007) XIC of +Q3: Experiment 2; 210.0 amu from Sample 4 [LC-L1HA-lip-12.08.2002-(84)-676735 of LCMS02_020814_0F3.wiff].

DESCRIPTION OF THE INVENTION

Figure 1:
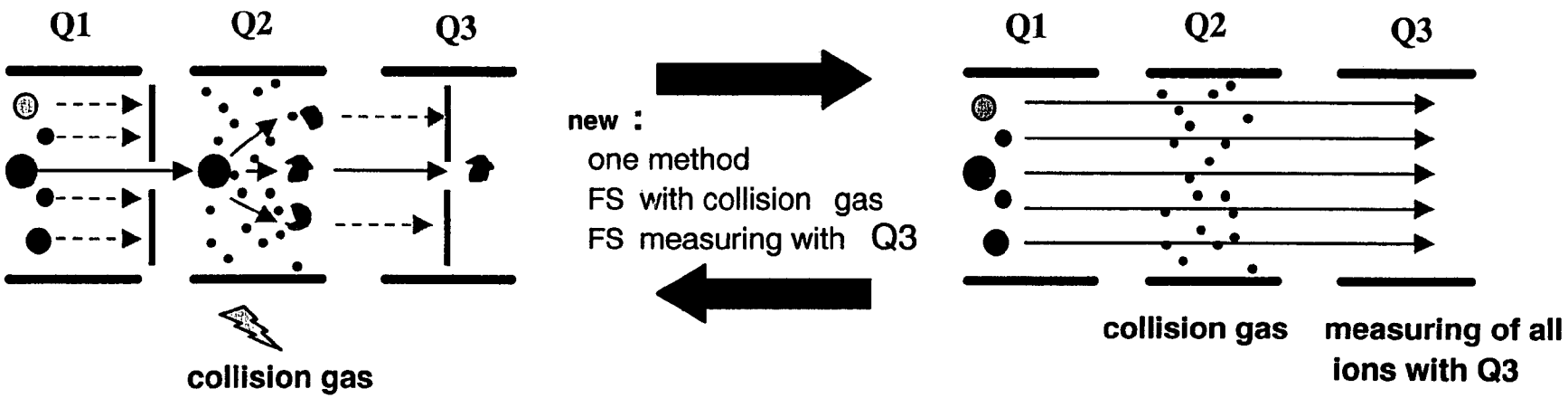
FIG. 1. Schematic diagram of one embodiment of the analytical process.

In the context of the invention, substance mixtures refer in principle to all mixtures which contain more than one substance, for example complex reaction mixtures of chemical syntheses such as synthesis products from combinatorial chemistry or substance mixtures of biological origin such as fermentation broths of an aerobic or anaerobic fermentation, body liquids such as blood, lymph, urine or stool, reaction products of a biotechnology synthesis using one or more free or bound enzymes, extracts of animal material such as extracts from different organs or tissues, or vegetable extracts such as extracts of the entire plant or individual organs such as root, stem, leaf, flower or seed or mixtures thereof. Advantageously, substance mixtures of biological origin are used in this process, such as extracts of animal or vegetable origin, advantageously of vegetable origin.

The mass spectrometers usable in the process are generally composed of a sample inlet system, an ionization chamber, an interface, ion optics, one or more mass filters and a detector.

To generate ions in the process, all ion sources known to those skilled in the art may in principle be used. Depending on the ion source used, these ion sources are coupled via an interface to the following components of the mass spectrometer, for example the ion optics, the mass filter or filters or the detector. The intermediate connection of an interface has the advantage that the analysis can be carried out without delay. In addition, it is possible to bring involatile and/or volatile, preferably involatile, substances directly into the gas phase using the ion source. It is thus also possible to carry out, via an advantageous chromatographic separation, prepurifications of substance mixtures which have substance fluxes of differing width in the analysis, since the interface allows these substance fluxes to be processed. The samples to be analyzed or the substances present therein may thus also be enriched. In addition, a wide range of solvents can be processed with very small loss of sample.

In the ionization, essentially three processes are used to generate the charged particles (ions):

a) Evaporation of the substance mixtures and ionization of the molecules or of the substance mixture in the gas phase, for example as in the electron impact ionization (EI) in which the molecules are evaporated at low pressure ($<10^{-2}$ Pa) in an ionization chamber using an electron beam, or as in chemical ionization (CI) using a reactant gas in the ions are generated at an elevated pressure of approx. 100 Pa. Typical reactant gases are, for example, methane, isobutane, ammonium, argon or hydrogen. When the chemical ionization is carried out at atmospheric pressure, this is referred to as atmospheric pressure chemical ionization (APCI).

b) Desorption of the substance mixtures from a surface, for example as in plasma desorption (PD), liquid secondary ion mass spectrometry (LSIMS), fast atom bombardment (FAB), laser desorption (LD) or matrix-assisted laser desorption ionization (MALDI).

In all of these methods, the substance mixtures are vibrationally excited in a collision cascade by incident energy-rich particles (radioactive decomposition, UV photons, IR photons, $Ar^+$or $Cs^+$ions, laser beams) and thus ionized.

c) Atomization of the substance mixtures in an electrical field, as in electrospray ionization (ESI). In the atomization of the substance mixtures in the electrical field, the samples are atomized at atmospheric pressure.

Electrospray ionization is a very gentle method. In ESI, ions are formed continuously. This continuous ion formation has the advantage that it can be coupled effortlessly in conjunction with almost any analyzer type, and that it can be connected without any problem to a chromatographic separation such as a separation via capillary electrophoresis (CE), liquid chromatography (LC) or high-pressure liquid chromatography (HPLC), since it has a good tolerance for high flow rates of up to 2 ml/min of eluate. The spraying of the eluent is promoted pneumatically by an atomization gas, for example nitrogen. To this end, the gas is blown, under a pressure of up to 4 bar, advantageously up to 2 bar, out of a capillary which encloses the inlet capillary of the eluent. Higher pressures are also possible in principle. In the upstream chromatographic separation, preference is given to normal phases (for example silica gel, alumina, aminodeoxyhexitol, aminodeoxy-d-glucose, triethylenetetramine, polyethylene oxide or aminodicarboxy columns) and/or reversed-phase columns, preferably reversed-phase columns such as columns having a $C_4$, $C_8$ or $C_{18}$ stationary phase. Under standard conditions, the electrospray technique, owing to the extremely gentle ionization, leads to the (quasi-)molecular ion. Usually, these are adducts with ions already present in the sample solution (for example protons, alkali metal ions and/or ammonium ions). It is also an advantage that multiply charged ions can also be detected, so that ions having a molecular weight of up to 100 000 daltons can be detected; advantageously, it is possible in the process according to the invention to detect molecular weights in a range from 1 to 10 000 daltons, preferably in a range from 50 to 8000 daltons, more preferably in a range from 100 k to 4000 daltons. Further exemplary methods include ion spray ionization, atmospheric pressure ionization (APCI) or thermospray ionization.

In the aforementioned ionization methods, the ionization process proceeds under atmospheric pressure and is divided essentially into three phases: initially, the solution to be analyzed is sprayed in a strong electrostatic field which is generated by applying a potential difference of 2–10 kV, advantageously of 2–6 kV, between the inlet capillary and a counterelectrode. An electrical field between the inlet capillary tip and the mass spectrometer penetrates the analyte solution and separates the ions in an electrical field. Positive ions are drawn to the surface of the liquid in the positive mode, negative ions in the opposite direction, or vice versa in the case of measurements in the positive mode. The positive ions accumulated on the surface are subsequently drawn further in the direction of the cathode. When spray capillaries (NanoSpray) are used in which the solution to be investigated is not expressed out of the capillary by the application of pressure, a liquid cone, known as the Taylor cone, is formed, since the surface tension of the liquid counteracts the electrical field. When the electrical field is strong enough, the cone is stable and continuously emits at its injection a liquid stream. In the case of pressure-assisted spraying of the solution to be investigated (for example with HPLC), the Taylor cone is not so marked.

In each case, an aerosol is formed which consists of analyte and solvent. In the following stage, the desolvation of the drops formed takes place, which leads to gradual reduction in the droplet size. The evaporation of the solvent is achieved by thermal action, for example by supplying hot inert gas.

The evaporation in conjunction with the electrostatic forces results in a steady increase in the charge density at the surface of the substance mixture droplets sprayed in. When the charge density or its charge repulsion forces finally exceed the surface tension of the droplets (known as the Raleigh limit), these droplets explode (Coulomb explosion) into smaller subdroplets. This process of "solvent evaporation/Coulomb explosion" is run through repeatedly until the ions finally pass over into the gas phase. In order to obtain good analytical results, the gas flow rate in the interface, the heating temperature applied, the flow rate of the heating gas, the pressure of the atomization gas and the capillary voltage have to be precisely monitored and controlled.

The different ionization processes allow singly or multiply charged ions to be generated. For the process according to the invention, the ionization processes used are advantageously processes for atomizing the substance mixture in an electrical field such as thermospray, electrospray (=ES) or atmospheric pressure chemical ionization (=APCI) processes. In APCI ionization, the ionization is effected in a corona discharge. Preference is given to the thermospray or electrospray process, particular preference to the electrospray process. The ionization chamber is connected to the mass spectrometer which follows via an interface, i.e. via a microaperture (100 μm). On the side of the ionization chamber is also mounted an interface plate having a larger aperture. Between this plate and the orifice, a heated carrier gas (=curtain gas), for example nitrogen, is blown in. The nitrogen collides with the ions, generated, for example, by electrospray, which have been generated in the substance mixture. Blowing in the curtain gas prevents, in an advantageous manner, neutral particles from being sucked into the high vacuum of the downstream mass spectrometer. In addition, the curtain gas supports the desolvation of the ions.

The process according to the invention may be carried out using all quadrupole mass spectrometers known to those skilled in the art, such as the triple quadrupole mass spectrometers. In U.S. Pat. No. 2,939,952, Paul et al. describe and claim a first such instrument. These instruments have an advantageous mass range of up to about m/z=4000 and achieve resolution values between 500 and about 5000. They have high ion transmission from the source to the detector, are easy to focus and to calibrate and advantageously have a high stability of the calibration in long-term operation. Triple quadrupole instruments are the standard instruments for low-energy collision activation studies.

Typically, these instruments consist of a first quadrupole which is suitable for analyzing the mass/charge quotient (m/z) of the ions present in the substance mixture after ionization in high vacuum (approx. $10^{-5}$ torr), and the mass(es) of individual ions, a plurality of ions or all ions may be measured. This first analytical quadrupole (=I or Q1) may be preceded by one or more quadrupoles (=Q0) which are generally used to focus the ions.

Instead of this or these preceding quadrupole(s), "cones", lenses or lens systems may be used to focus and introduce the ions into the first analytical quadrupole. Combinations of quadrupoles and cones have also been realized and can be used.

A further quadrupole following Q1 (=II or Q2) serves as a collision chamber. Therein, the ions are advantageously fragmented by applying a fragmentation voltage. For the fragmentation, ionization potentials in the range of 5–11 electron volts (eV), preferably of 8–11 electron volts (eV), are applied. For the fragmentation in the process according to the invention, Q2 is also filled with a collision gas such as a noble gas such as argon or helium, or another gas such as $CO_2$ or nitrogen, or mixtures of these gases such as argon/helium or argon/nitrogen. For reasons of cost, preference is given to argon and/or nitrogen. In the collision chamber, the collision gas in the process according to the invention is preferably present at a pressure of from $1\times10^{-5}$ to $1\times10^{-2}$ torr, preferably $10^{-2}$ torr. Particular preference is given to nitrogen. Even without the application of a fragmentation voltage, there may be isolated fragmentation of the ions in the collision chamber in the presence of a collision gas. Between the quadrapole Q1 and Q2, further quadrupoles or cones may be present to direct the ions.

Downstream of the quadrupole Q2 which serves as the collision chamber is finally disposed a further quadrupole (=III or Q3). In this Q3, either the m/z quotients of individual selected fragments, a plurality of or else all of the m/z quotients present in the substance mixtures after ionization (referred to in this application as mass or masses for the sake of simplicity) may be determined. Further quadrupoles or cones may also be present between the quadrupole Q2 and Q3 to direct the ions.

In the process according to the invention, individual quadrupoles may also be operated as ion traps to collect ions, from which the ions may then be released again for analysis after a certain time.

The quadrupoles used in the triple quadrupole mass spectrometers generate a three-dimensional electrical field in which the ions generated can be held or directed. They generally consist of 4, 6 or 8 rods or poles, with the aid of which an oscillating electrical field is generated, and opposite rods are electrically connected. In addition to the term quadrupole, the terms hexapole or octapole are also used. In the present application, these terms are also included when the term quadrupole is used. Advantageously, the ions are directed in the quadrupoles of the triple quadrupole mass spectrometer using only small acceleration voltages of a few volts, preferably of a few 10s of V.

In the process according to the invention, substance mixtures such as animal or vegetable extracts, preferably vegetable extracts, are advantageously used.

In the process according to the invention, the further process steps are run through after the ionization of the substance mixtures.

I) In process steps (a) to (c), the mass of at least one ion present in the substance mixture is analyzed and selected after ionization in Q1. This selected ion is subsequently fragmented in Q2 in the present of collision gas and a fragmentation voltage and then one of the fragment ions formed is identified in a further analytical quadrupole Q3 and advantageously also quantified. The fragment ion to be analyzed is selected in such a way that this ion advantageously has a high intensity and a readily identifiable characteristic mass, and, in an advantageous embodiment of the process, enables easy quantification.

II) Subsequently, in process step (d), the masses of all ions present in the substance mixture after ionization are analyzed, in which case the quadrupole Q2 utilized as a collision chamber is always filled with collision gas, but no fragmentation voltage is applied to Q2 in process step (d). This analysis may in principle be carried out both with Q2 and with Q3, but it is more advantageous to analyze with Q3, since the quadrupole Q2 used as the collision chamber is disposed between Q1 and the detector downstream of the mass spectrometer. Should a fragmentation occur in Q2 despite the absence of an applied fragmentation voltage, this has no influence on a possible capture of the ion masses at the detector. However, in the case of a mass analysis using Q1, such a fragmentation in Q2 would lead to false conclusions in the detection. Preference is therefore given to mass detection using Q3, since possible sources of error are eliminated or are negligible.

The process steps detailed above, (I) and (II), may also be carried out in the reverse sequence. The course of the process according to the invention can be taken from FIG. 1. In the process according to the invention, process steps (b) to (d) and (e) are advantageously run through at least once within from 0.1 to 10 seconds, preferably at least once within from 0.2 to 6 seconds, more preferably within from 0.2 to 2 seconds, most preferably at least once within from 0.3 to less than 2 seconds. In order to enable an advantageous statistical evaluation of the results, the process steps are run through two to three times, preferably three times, within from 0.2 to 6 seconds. In order to enable such rapid measurements in rapid succession, the quadrupole Q2 functioning as a collision chamber is always filled with collision gas. As in-house measurements have shown, this has no adverse influence on the reproducibility of the measurements.

During an analysis in the process according to the invention, between 1 and 100 mass/charge quotients of different ions formed in step (a) and selected may be analyzed. Advantageously, at least 20 m/z quotients, preferably at least 40 m/z quotients, more preferably at least 60 m/z quotients, most preferably at least 80 m/z quotients, of different ions or more are identified and/or quantified.

With the aid of the process according to the invention, it is advantageously possible, in addition to the analysis of all masses present in a substance mixture, also to analyze and advantageously quantify individual substances or their masses.

A purification of the substance mixtures in the process according to the invention is in principle not required. The substance mixtures may be analyzed directly after introduction into an ion source. This is also true of complex substance mixtures. It is also unnecessary to add to the substance mixtures, as internal standards, any labeled or unlabeled pure substances of possible substances present in the mixtures, although this is of course possible and simplifies the subsequent quantification of the substances present in the mixtures.

However, a purification via processes known to those skilled in the art, such as chromatographic processes, is advantageous. On the basis of the ionization method, preferred in the process according to the invention, via an atomization of the substance ixtures in the electrical field, it is possible in a very simple manner to couple to the mass spectrometry analysis a purification and/or prepurification of the substance mixtures, for example via chromatography. The chromatographic processes used may be all separation methods known to those skilled in the art such as LC, 5 HPLC or capillary electrophoresis. Separation processes which are based on adsorption, gel permeation, ion pair, ion exchange, exclusion, affinity, normal-phase or reversed-phase chromatography, to name only a few possibilities, may be used. Advantageously, chromatographies based on normal phase and/or reversed phase, preferably reversed-phase columns having different hydrophobic modified materials such as $C_4$, $C_8$ or $C_{18}$ phases are used.

In the process according to the invention, it is possible, for example, to couple purification methods, advantageously chromatography methods, with a flow rate of the eluent (analyte+solvent) of advantageously between 1 μl/min to 2000 μl/min, preferably between 5 μl/min to 600 μl/min, more preferably between 10 μl/min to 500 μl/min. Lower or higher flow rates may also be used in the process according to the invention without difficulties.

The solvents used for the purification process may in principle be any protic or aprotic, polar or nonpolar solvents which are compatible with the subsequent analysis. Whether a solvent is compatible with the mass spectrometry can be determined readily by those skilled in the art by simple spot checks. Suitable solvents are, for example solvents which bear few charges, if any, such as aprotic apolar solvents which are characterized by a low dielectric constant ($E_D$<15), low dipole moments (μ<2.5D) and low $E_T^N$ values (0.0–0.5). However, dipolar organic solvents or mixtures thereof are also suitable as solvents for the process according to the invention. Examples of suitable solvents here are methanol, ethanol, acetonitrile, ethers, heptane. Weak acidic solvents such as 0.01–0.1% formic acid, acetic acid or trifluoroacetic acid are also suitable. Moreover, weakly basic solvents such as 0.01–0.1% triethylamine or ammonia are also suitable. Strongly acidic or strongly basic solvents such as 5% HCl or 5% triethylamine are also suitable in principle as solvents. Mixtures of the aforementioned solvents are also advantageous. Also suitable as solvents are the buffers customary in biochemistry, and it is advantageous to use <200 mM buffers, preferably <100 mM, more preferably <50 mM, most preferably <20 mM. It is likewise advantageous, when >100 mM buffers are used for the preparation of the substance mixtures, that the buffers are fully or partly removed, for example by dialysis. Buffers include, for example, acetate, formate, phosphate, Tris, MOPS, HEPES or mixtures thereof. High buffer and/or salt concentrations have a negative influence on the ionization processes and are to be avoided in some cases.

In the process according to the invention, it is possible to detect, i.e. identify and, if appropriate, also quantify, molecules which are present in the substance mixtures of from 100 daltons (=D) to 100 kilodaltons (=kD), preferably from 100 D to 20 kD, more preferably of 100 D–10 kD, most preferably from 100 D to 2000 D.

Advantageously, the substance mixtures for the process according to the invention which can otherwise only be detected with difficulty, if at all, are derivatized before the analysis and thus finally analyzed. A derivatization is particularly advantageous in cases in which hydrophilic groups which advantageously still bear an ionizable functionality are introduced into hydrophobic or volatile compounds, for example esters, amides, lactones, aldehydes, ketones, alcohols, etc. Examples of such derivatizations are conversions of aldehydes or ketones to oximes, hydrazones or derivatives thereof, or alcohols to esters, for example with symmetric or mixed anhydrides. This advantageously allows the detection spectrum of the process to be widened.

Advantageously, in the process according to the invention for analyzing the substance mixtures, an internal standard, for example peptides, amino acids, coenzymes, sugars, alcohols, conjugated alkenes, organic acids or bases, is added. This internal standard advantageously enables the quantification of the compounds in the mixture. Substances present in the substance mixture may thus be more readily analyzed and ultimately quantified.

The internal standard used is advantageously a labeled substance, although unlabeled substances may in principle also be used as the internal standard. Such similar chemical compounds are, for example, compounds of a homologous series whose members differ only by, for example, an additional methylene group. The internal standard used is preferably a substance labeled by at least one isotope selected from the group of $^{2}H$, $^{13}C$, $^{15}N$, $^{17}O$, $^{18}O$, $^{33}S$, $^{34}S$, $^{36}S$, $^{35}Cl$, $^{37}Cl$, $^{29}Si$, $^{30}Si$, $^{74}Se$ or mixtures thereof. For reasons of cost and for reasons of availability, the isotope used is preferably $^{2}H$ or $^{13}C$. These internal standards do not need to be fully labeled for the analysis. Partial labeling is entirely sufficient. In the case of a labeled internal standard, a substance is advantageously also selected which has very high homology to the substances in the mixture to be analyzed, i.e. structural similarity to the chemical compound to be analyzed. The higher the structural similarity, the better the analytical results and the more precise quantification of the compound may be.

For the process according to the invention and particularly for the quantification of the substances present in the mixture, it is advantageous to use the internal standard in a favorable ratio to the substance to be analyzed. Ratios of analyte (=compound to be determined) to internal standard of greater than 1:15 do not lead to any improvement in the analytical results, but are possible in principle. Advantageously, a ratio of analyte to internal standard in a range from 10:1 to 6:1 is set, preferably in a range from 6:1 to 4:1, more preferably in a range from 2:1 to 1:1.

The substance mixture samples in the process according to the invention may be prepared manually or advantageously automatically with customary laboratory robots. The analysis with the mass spectrometer after any chromatographic separation may also be carried out manually or advantageously automatically. The automation of the process according to the invention allows the mass spectrometry to be used advantageously for the rapid screening of different substance mixtures, for example plant extracts, in high-throughput screening. The process according to the invention features high sensitivity, good quantifiability, outstanding reproducibility, with very low sample consumption. The method may thus also be used to rapidly find mixtures of biological origin, for example novel mutants of known or unknown enzymatic activities after a mutagenesis, for example after a classical mutagenesis using chemical agents such as NTG, radiation such as UV radiation, or X-radiation, or after a site-directed mutagenesis, PCR mutagenesis, transposon mutagenesis or gene shuffling.

The process according to the invention enables the analysis of a wide range of substances in a wide analysis range, with good to very good resolution, with high ion transmission from the source to the detector, a high scan rate, both in full scan mode of all substances in the substance mixtures and in multiple reaction monitoring mode (=MRM, process steps (a) to (c)). In addition, the process has a very high uptake sensitivity and outstanding calibration stability. In addition, it is outstandingly suitable for long-term operation and thus for use in an HTS screening.

The invention is illustrated in detail by the examples which follow:

The following examples illustrate embodiments of the invention, but should not be viewed as limiting the scope of the invention.

EXAMPLES

1. Examples of MRM+FS analyses a) TIC of the MRM+FS analysis

Figure 2:
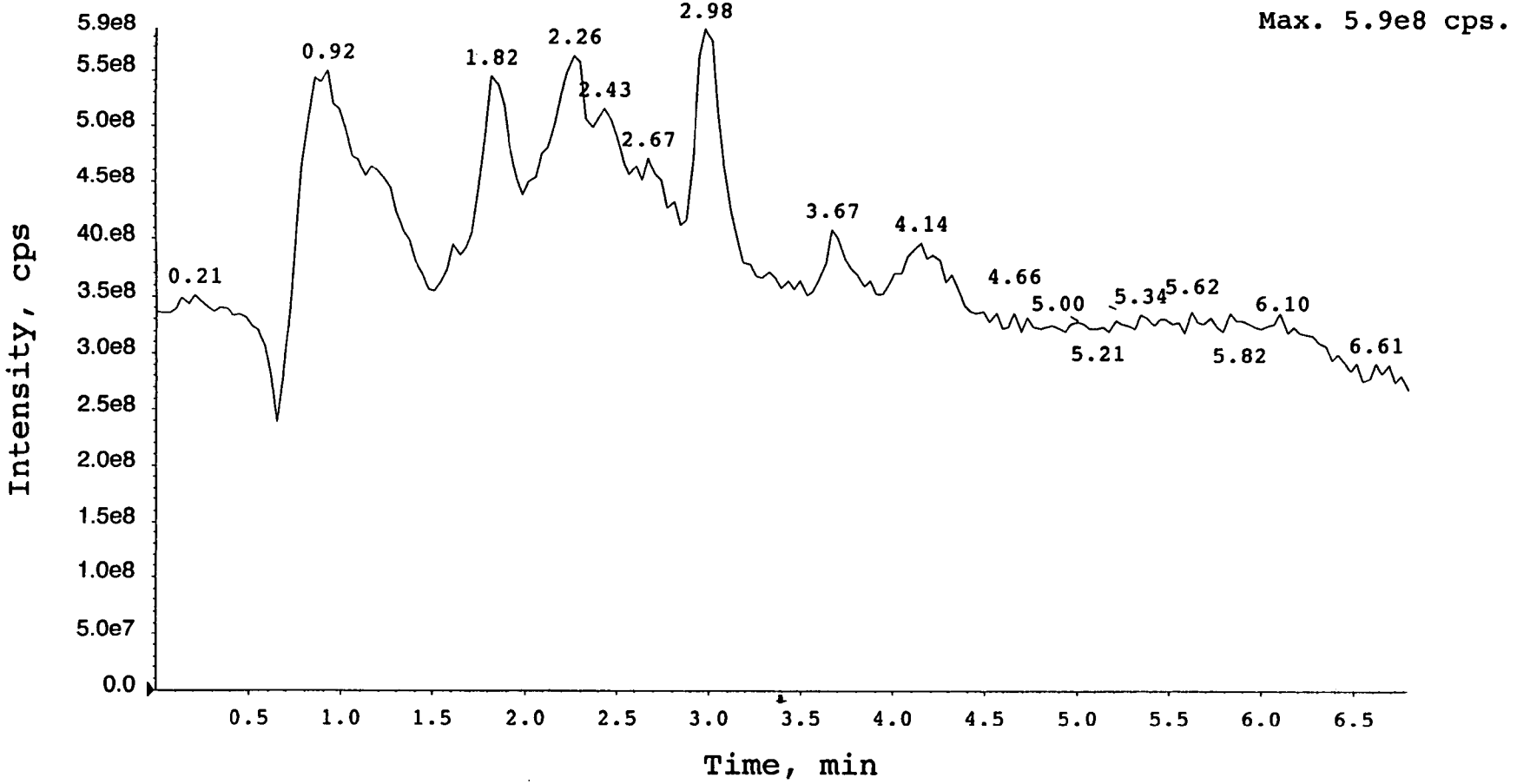
FIG. 2. Total ion chromatograph (TIC) of an MRM+full scan analysis TIC: from Sample 2 (QC 1) of LCMS04_020207_0F1.wiff.

FIG. 2 shows the total ion chromatogram of an MRM+full scan analysis [MRM=multiple reaction monitoring, FS=full scan, TIC=total ion chromatogram, XIT=sum of a plurality of total ion chromatograms]. A quality control sample was analyzed. This type of sample contains a defined number of analytes. These analytes were obtained commercially and dissolved in suitable solvent in known concentrations.

The illustration of the analysis selected in FIG. 2 shows the summation of the intensities measured at the detector (y-axis) at the particular times (x-axis) from the two mass spectrometry experiments of multiple reaction monitoring (MRM) and of full scan (FS). The chromatogram in FIG. 2 thus constitutes the sum of the TIC chromatograms of the two abovementioned mass spectrometry experiments.

b) TIC of the MRM experiment and TIC of the FS experiment

Figure 3:
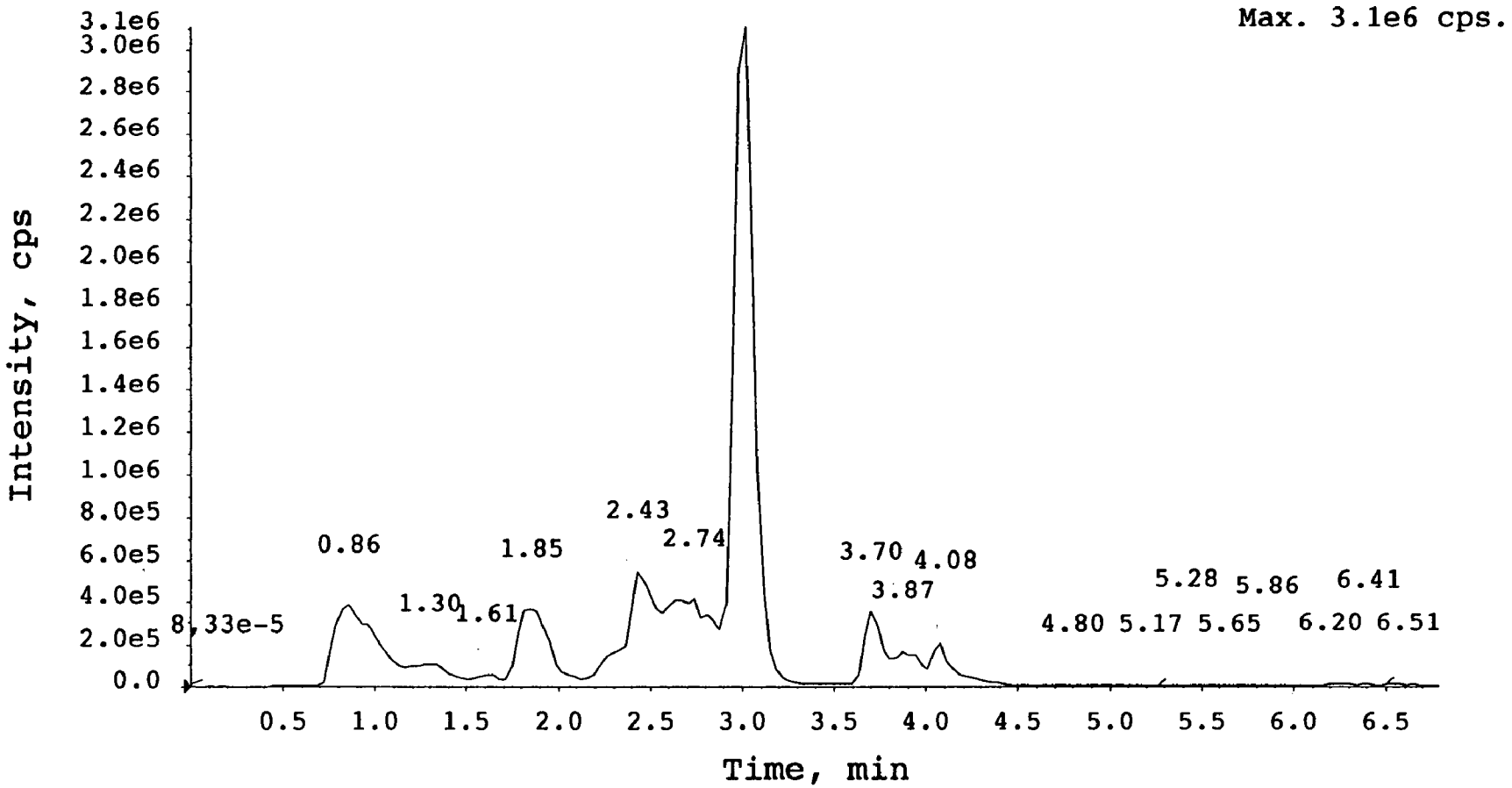
FIG. 3. Total ion chromatograph (TIC) of the MRM experiment from an MRM+FS analysis TIC of +MRM (30 pairs): Experiment 1 from Sample 2 (QC 1) of LCMS04_020207_0F1.wiff.

FIG. 3 shows the total ion chromatogram of the MRM experiment from an MRM+FS analysis.

Figure 4:
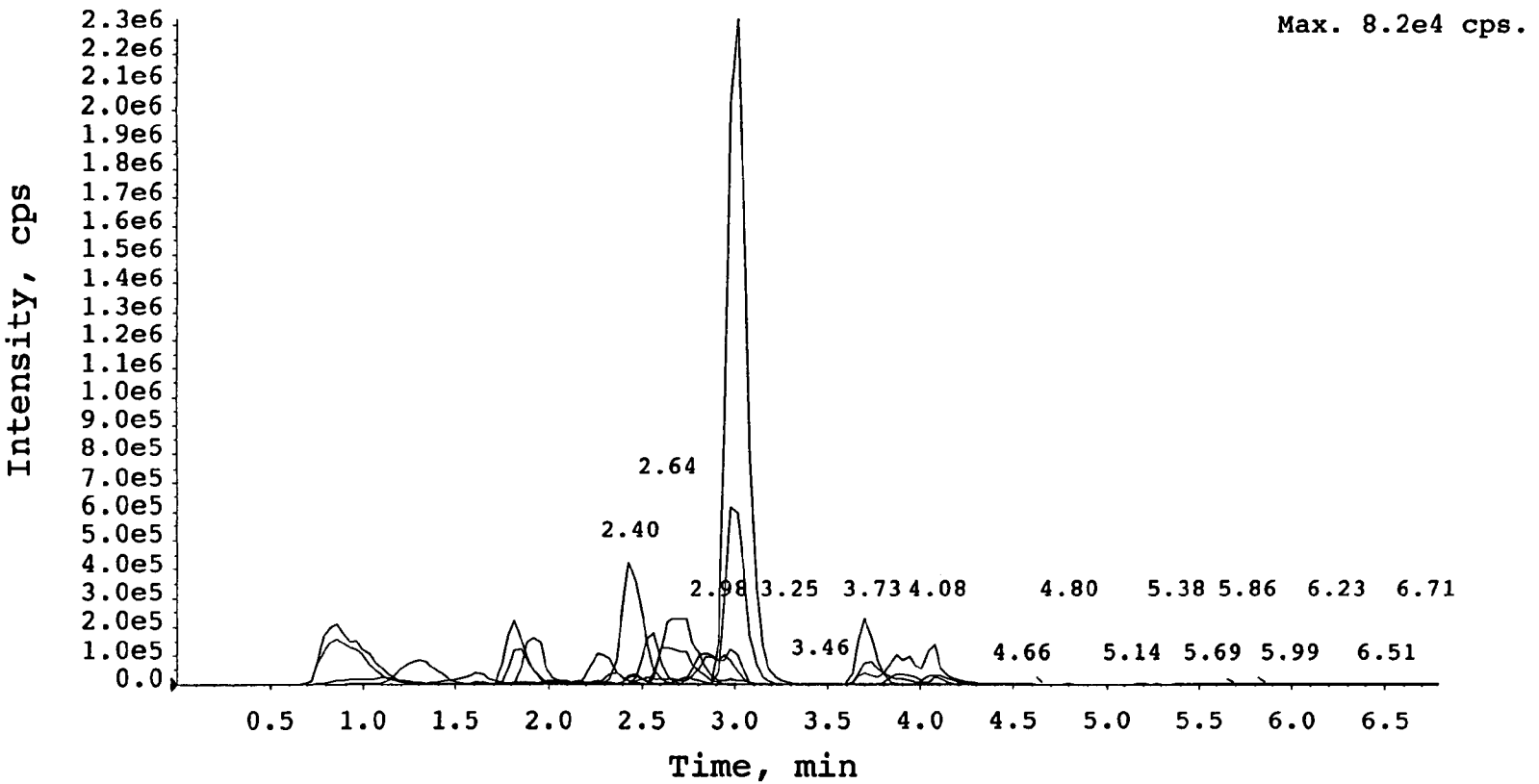
FIG. 4. Total ion chromatograph (TIC) of the MRM experiment from an MRM+FS analysis XIC of+MRM (30 pairs): Experiment 1; 536.4/69.0 amu from Sample 2 (QC 1) of LCMS04_020207_0F1.wiff.

The illustration of the MRM analysis selected in FIG. 3 shows the summation of the intensities measured at the detector (y-axis) at the particular times (x-axis) from all predefined mass transitions of the MRM experiment. The illustration selected in FIG. 4 shows the particular analytical results of each individual mass transition (30 here) on a set of axes.

c) TIC of the FS experiment

Figure 5:
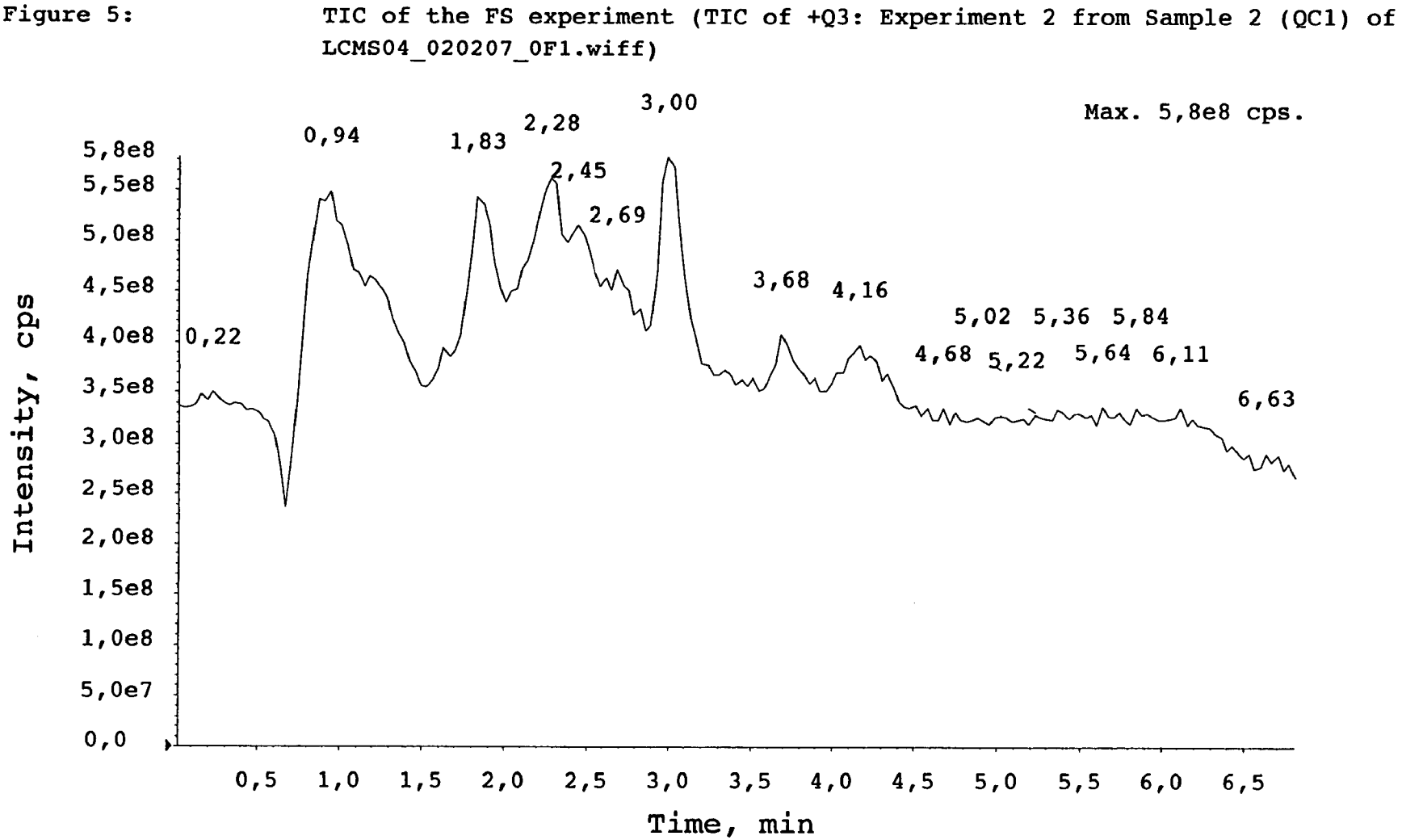
FIG. 5. TIC of the FS experiment (TIC of +Q3: Experiment 2 from Sample 2 (QC 1) of LCMS04_020207_0F1.wiff).

The FS experiment, measured in alternation to the MRM experiment, is shown in the TIC in FIG. 5.

Figure 6:
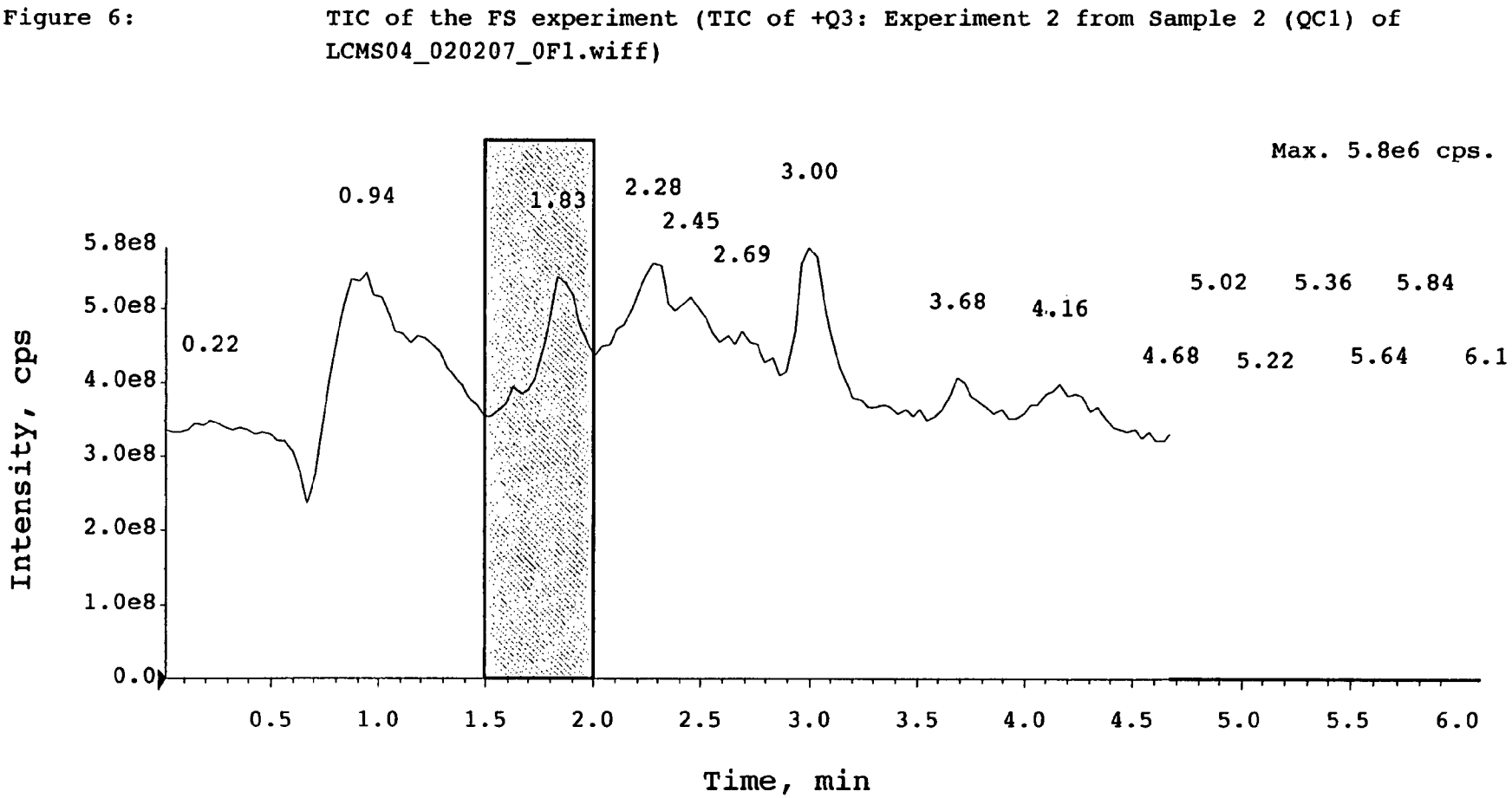
FIG. 6. TIC of the FS experiment (TIC of +Q3: Experiment 2 from Sample 2 (QC 1) of LCMS04_020207_0F1.wiff).

FIG. 6 shows the TIC of the FS experiment. The summation of all FS mass spectra which have been recorded in the time window shown hatched are shown in FIG. 7.

d) TIC of an MRM experiment

As in FIG. 2, FIG. 8 shows a total ion chromatogram of an MRM+full scan analysis. A calibration sample was analyzed. The illustration of the analysis, selected in FIG. 8, shows the summation of the intensities measured at the detector (y-axis) at the particular times (x-axis) from the mass spectrometry experiment of multiple reaction monitoring.

FIG. 9 reproduces an extracted chromatogram in which coenzyme Q 10 has been identified.

FIG. 10 and FIG. 11 reproduce the identification of in each case capsanthin and bixin.

FIG. 12 reproduces a total ion chromatogram of a full scan of a plant extract.

FIGS. 13 to 15 show the masses of different analytes in the extracted chromatogram, which still have to be assigned to a specific structure.

In the process described, it has been possible hitherto to selectively detect 200 further analytes.

What is claimed is:

1. A mass spectrometry process for analyzing a mixture of substances using a triple quadrupole mass spectrometer, wherein said mixture is ionized before the analysis, which comprises the following steps:

a) selecting a mass/charge quotient (m/z) of an ion formed by ionization in a first analytical quadrupole (I) of the mass spectrometer, b) fragmenting the ion selected by applying an acceleration voltage in a following quadrupole (II) which is filled with a collision gas and functions as a collision chamber, c) selecting a mass/charge quotient of the fragment ion in a downstream quadrupole (III), and d) analyzing the mass/charge quotients of additional ions present in the mixture as a result of the ionization, wherein the following quadrupole (II) is filled with a collision gas but no acceleration voltage is applied during the analysis;

and wherein the steps (a) to (c) and step (d) may also be carried out in reverse sequence.

2. The process of claim 1, wherein the ionization of the mixture is upstream of a chromatographic separation.

3. The process of claim 2, wherein the chromatographic separation is an HPLC separation.

4. The process of claim 2, wherein the mixture is derivatized before the chromatographic separation.

5. The process of claim 1, wherein steps (a) to (d) are run through at least once within from 0.1 to 10 seconds.

6. The process of claim 1, wherein steps (a) to (d) are run through at least once within from 0.2 to 2 seconds.

7. The process of claim 1, wherein the ionization is effected by evaporating the mixture and ionizing in a gas phase.

8. The process of claim 1, wherein the ionization is effected by atomizing the mixture in an electrical field.

9. The process of claim 1, wherein analysis is effected in step (a) between 1 and 100 mass/charge quotients of different ions formed by ionization and selected.

10. The process of claim 1, wherein the mixture is of biological or chemical origin.

11. The process of claim 1, wherein the mixture is derivatized before the analysis.

12. The process of claim 1, wherein the substances within the mixture are not required to be purified.

13. The process of claim 1, which further comprises a high-throughput screening.

14. The process of claim 1, wherein the fragment ion analyzed in step (c) is quantified for all ions present in the mixture.

15. The process of claim 1, wherein the ionization is effected by desorbing the mixture on a surface.

16. The process of claim 1, wherein the (m/z) quotient analyzed in step (d) is quantified for all ions present in the mixture.

17. The process of claim 1, wherein both the fragment ion analyzed in step (c) and the (m/z) quotient analyzed in step (d) are quantified.

18. The process of claim 1, wherein both the fragment ion analyzed in step (c) and the (m/z) quotient analyzed in step (d) are quantified for all ions present in the mixture.

19. A mass spectrometry process for analyzing a mixture of substances, which does not require purification of said substances, comprising:

(a) ionizing said mixture by evaporating and ionizing the mixture in a gas phase, by desorbing the mixture on a surface, or by atomizing the mixture in an electrical field;

(b) selecting a mass/charge quotient (m/z) of an ion formed by ionization in a first analytical quadrupole (I) of a triple quadrupole mass spectrometer;

(c) fragmenting the ion selected by applying an acceleration voltage in a following quadrupole (II) which is filled with a collision gas and functions as a collision chamber;

(d) selecting a mass/charge quotient of the fragment ion in a downstream quadrupole (III); and (e) analyzing the mass/charge quotients of additional ions present in the mixture as a result of the ionization, wherein the following quadrupole (II) is filled with a collision gas but no acceleration voltage is applied during the analysis;

and wherein steps (b) to (d) and step (e) may be carried out in reverse sequence.

20. The process of claim 19, wherein one or more of the substances within the mixture are identified and quantified.

* * * * *